United States Patent [19]

Moore et al.

[11] Patent Number: 4,908,149

[45] Date of Patent: Mar. 13, 1990

[54] CLEANING COMPOSITION FOR TEXTILES CONTAINING SULFONATED COLORLESS DYE SITE BLOCKER

[75] Inventors: Patrick D. Moore, Spartanburg; Jack L. Rolen, Campobello; Linda G. Coté, Greenville, all of S.C.

[73] Assignee: Milliken Research Corporation, Spartanburg, S.C.

[21] Appl. No.: 204,840

[22] Filed: Jun. 10, 1988

[51] Int. Cl.[4] ..... C11D 3/12; C11D 3/37; C11D 7/34

[52] U.S. Cl. ..... 252/139; 252/88; 252/91; 252/164; 252/166; 252/170; 252/171; 252/174; 252/174.17; 252/174.23; 252/545; 252/547; 252/550; 252/549; 252/558; 252/174.16; 252/DIG. 2; 252/DIG. 14; 252/135

[58] Field of Search ..... 252/88, 90, 91, 135, 252/153, 154, 155, 174, 174.13, 554, 550, 549, 558, DIG. 14, 162–167, 170, 171, 545, 174.17, 547, DIG. 2

[56] References Cited

U.S. PATENT DOCUMENTS

| | | | |
|---|---|---|---|
| 3,910,848 | 10/1975 | Froehlich et al. | 252/90 |
| 3,919,101 | 11/1975 | Anstett et al. | 252/90 |
| 4,013,594 | 3/1977 | Froehlich et al. | 252/544 |
| 4,108,800 | 8/1978 | Froehlich | 252/541 |
| 4,111,854 | 9/1978 | Spadini et al. | 252/541 |
| 4,194,993 | 3/1980 | Deal, III | 252/541 |
| 4,244,834 | 1/1981 | Schwalley et al. | 252/106 |
| 4,304,675 | 12/1981 | Corey et al. | 252/8.6 |
| 4,395,347 | 7/1983 | McLaughlin et al. | 252/139 |
| 4,434,067 | 2/1984 | Malone et al. | 252/88 |
| 4,440,661 | 4/1984 | Takeuchi et al. | 252/89.1 |
| 4,552,692 | 11/1985 | Gillespie | 252/528 |
| 4,592,940 | 6/1986 | Blyth et al. | 428/96 |
| 4,833,009 | 5/1989 | Marshall | 428/267 |

FOREIGN PATENT DOCUMENTS

| | | |
|---|---|---|
| 2015972 | 4/1970 | France . |
| 2240287 | 4/1975 | France . |
| 2211865 | 12/1989 | United Kingdom . |

OTHER PUBLICATIONS

Fifth Generation Nylon Carpet-Market and Technology Review, Edward A. Duffy, Technical Center, Allied Fibers, Petersburg, Va.

*Primary Examiner*—Prince E. Willis
*Attorney, Agent, or Firm*—Terry T. Moyer; H. William Petry

[57] ABSTRACT

A liquid or dry, flowable cleaning composition for carpeting is provided which comprises: (1) a cleaning fluid selected from water containing sufficient surfactant to lower the surface tension to below 40 dynes per centimeter, an organic liquid, or mixtures of water, surfactant and organic liquid; and (2) a sulfonated, colorless dye site blocker provided in a sufficient amount to prevent or minimize deterioration of stain resistance properties in fifth generation nylon carpets. In the case of a dry-type composition sufficient particulate material is added to provide a dry, flowable product.

15 Claims, No Drawings

CLEANING COMPOSITION FOR TEXTILES CONTAINING SULFONATED COLORLESS DYE SITE BLOCKER

The present invention relates to a cleaning composition for textiles which contains a sulfonated, colorless dye site blocker. More particularly, the present invention relates to a cleaning composition for textile materials, especially carpeting, made in whole or in substantial part from stain resistant polyamide fibers.

The cleaning of textile materials such as carpeting has in the past generally been accomplished by means of a wide variety of cleaning compositions including liquid compositions, such as carpet shampoos and steam extraction compositions, foamed compositions, typically used as spot cleaners, and solid, particulate type compositions which contain sufficient solid, particulate material to render the cleaning composition flowable as a solid powder at standard conditions of temperature and pressure.

Liquid carpet cleaning compositions generally contain, in addition to a liquid aqueous or organic solvent component, a surfactant to lower the surface tension of the liquid and provide soil-attracting characteristics. Surfactants, in general may be said to be present in both liquid, shampoo formulations and in liquid, steam extraction formulations. Foamed carpet cleaning compositions generally contain, in addition to the above solvent and surfactant components, a foaming agent so that the cleaning composition is concentrated on the surface of the carpet or other textile material. Such foamed compositions are frequently applied from aerosol cans and have been found to be convenient where spot cleaning of the carpeting may be desired.

Powdered or dry-type carpet cleaning compositions generally contain, in addition to a liquid component and surfactant component, any of a rather wide variety of solid particulate materials including natural materials such as wood flour as well as polymeric materials including polyurethanes, polystyrenes and phenolformaldehyde resin particles as disclosed in French Patent No. 2,015,972.

More recently, as disclosed in U.S. Pat. No. 4,013,594, incorporated by reference, a powdered cleaning composition made from highly porous particles of urea formaldehyde resin was disclosed and was reported to have improved cleaning characteristics as compared to certain other powdered cleaning formulations.

While the maintenance, especially cleaning, of carpeting has been approached from the standpoint of a variety of cleaning compositions applied subsequent to manufacture to remove soil, preventative maintenance has also been the subject of a great deal of research especially as to chemical modification of the fibers used to make the carpeting product. Thus, one of the most favored fibers for use in the manufacture of carpeting especially in the United States today, is polyamide fiber including Nylon 6/6 (polyhexamethyleneadipamide) and Nylon 6 (polycaprolactam). Over the years various improvements have been made in the basic nylon fibers and as these improvements were introduced they were referred to as second, third, fourth and fifth generation nylon fibers. Second generation nylon fibers included certain changes in the cross-sectional dimension of the fiber and reduced packing of the fibers. Third generation fibers provided certain anti-static characteristics to the nylon fibers. More recently, the fourth generation of nylon fibers included efforts to reduce surface energy and soiling which was accomplished by the introduction of a fluorochemical during the manufacturing process which resulted in a rather uniform and generally superior performing product than was the case with previous generation products. Still certain problems remained and certain stains were found to be particularly difficult to remove from nylon fibers. For instance, cherry Kool Aid in particular, which contains Red Dye No. 40, an acid dye, was found to be a particularly difficult if not impossible stain to remove from even the more recently introduced fourth generation nylon fibers. Stains from other food products containing acid dyes were also found to be difficult to remove from nylon carpet products, even the so-called fourth generation products.

In response to these deficiencies which had been observed, the major carpet fiber manufacturers introduced in late 1986 a new stain resistant nylon carpet fiber into the residential carpet market. This technology, referred to as "fifth generation," is the latest step in a continuing evolution directed at improving the performance of carpets. This concept has gained considerable acceptance and in 1988 it is expected that 80% of the nylon carpets produced will include this feature.

Fifth generation nylon carpet fibers build on the low surface energy afforded by fluorotreatment of fourth generation nylon with the controlled placement of a stain resist chemical on the outer periphery of the nylon fiber. These stain resist chemicals, which typically are applied either in a batch or a continuous manner during the manufacturing process, effectively resist the absorption by the nylon fibers of staining materials. In this regard, the industry has come to accept a particular test which has been developed to determine the general stain resistance characteristics of these new fibers. This test involves application to the carpeting of a series of cherry Kool Aid stains which contain Red Dye No. 40. Attempts are made to remove these stains after a period of time by flooding the stain with water and blotting it to remove the water and hopefully the stain as well. In general, carpeting made of these fifth generation nylon fibers performs quite well when tested by this recognized testing technique.

It has been found, however, that the performance of floor covering products made from these fifth generation nylon fibers may be adversely affected after the carpeting has been cleaned using conventional liquid (shampoo or steam extraction), foamed or even so-called dry-type cleaning systems. In particular, after the carpeting has been cleaned several times it has been observed with regard to certain of the fifth generation nylon products that virtually all of the improved performance attributable to the application of the stain resist chemicals as described above for fifth generation nylon products has been destroyed. It has been found quite surprisingly, however, according to this invention, that by the incorporation of a sulfonated dye site blocker into typical cleaning formulations that the tendency of the cleaning formulations to either destroy or degrade the stain resistant properties of fifth generation nylon products may be diminished if not eliminated entirely.

According to the present invention an improved cleaning composition for carpeting is provided which comprises: (1) a cleaning fluid selected from water containing sufficient surfactant to lower the surface tension to below 40 dynes per centimeter, an organic liquid, or mixtures of water, surfactant and organic liquid; and (2) a sulfonated, colorless dye site blocker provided in a sufficient amount to prevent or minimize deterioration of stain resistance properties in fifth generation nylon carpets.

As mentioned above, the cleaning compositions of the present invention include an essential component a sulfonated colorless dye site blocker. It has, of course, in general been known for some time that such colorless sulfonated dye site blockers may be applied to nylon fibers during the manufacturing process. Thus, for instance, it has been reported that such compounds may be applied to the fiber before the carpeting is manufactured, or may be applied even during the dyeing of the carpeting. Such applications, however, it has been thought, required, for the stain resistance characteristics to be observable maintenance of certain processing parameters including temperature, time, pH and concentration of the colorless sulfonated dye site blocker in the formulation. Thus, it has for instance in general been considered to be necessary that such compounds be applied out of solutions having a generally acidic pH. Maintenance of certain temperature requirements were also thought to be critical during the application technique and, in particular, it has been considered to be destructive of the stain resistance characteristics of such fifth generation nylons to subject them to relatively high temperatures. It has nowhere been suggested in the art, however, that such sulfonated colorless dye site blockers could be incorporated into a cleaning composition to either prevent or minimize the otherwise destructive effects of the cleaning composition on the performance of fifth generation nylon fibers.

In general, the amount of colorless sulfonated acid dye site blocker present in the cleaning composition may range over a wide range, e.g. from about 1 to about 10, preferably from about 2 to about 5% by weight based upon the total weight of the composition.

A wide variety of sulfonated colorless dye site blockers may be employed. Preferred materials may include sulfonated phenol-formaldehyde condensation products of the type disclosed in U.S. Pat. No. 4,501,591 to Ucci, et. al. (Monsanto Company), incorporated by reference. These materials are commercially available from Crompton & Knowles under the trade name Intratex® N and from Ciba Geigy under the trade name Erional® PA and Erional® NW. These materials are typically linear, low molecular weight condensation products, that is, products having an average molecular weight of less than about 1000, for example, in the range of 250 to 700. Such products are water-soluble and may be prepared by conventional art-recognized techniques, for example, by condensation of formaldehyde with one or more phenols in a mole ratio of about 1.0 to 0.8, phenol(s) to formaldehyde, at a pH of less than 7 using an acid catalyst such as HCl, wherein at least one of the phenols is a phenolsulfonic acid or alkali metal salt thereof. Preferably, the phenols comprise, in addition to the sulfonic acid or salt thereof, a sulfone, for example, dihydroxy diphenol sulfone. Such condensation products contain, in addition to sulfonic acid groups or alkali metal salts thereof, sulfone groups. Condensation products of this type are commercially available, for example, Intratex® N and Erional® PA. A preferred condensation product is the condensation product of formaldehyde with a mixture consisting essentially of an alkali metal salt of para-phenol sulfonic acid and 4,4'-diphenolsulfone in mole ratio ranging from 3:1 to 1:3, sulfone to sulfonic acid.

As a practical matter, condensation products which may be used are those prepared from relatively inexpensive, commercially available monomers such as phenol, diphenolsulfone, formaldehyde, ortho- and paraphenolsulfonic acids or salts thereof, and mono- and disulfonated diphenolsulfones or salts thereof. Examples of such salts include the ammonium, sodium, potassium or lithium salts thereof. Instead of or in addition to formaldehyde another aldehyde, such as, furfuraldehyde or benzaldehyde may be used. Also, instead of or in addition to a phenol or phenols a corresponding naphthol or naphthols may be used, for example, instead of sodium phenolsulfonate, sodium naphthol sulfonate may be used.

Other sulfonated compounds which may be even more preferred than those disclosed in U.S. Pat. No. 4,501,591 include the condensation products prepared from mono-sulfonic acids of the type disclosed in U.S. Pat. No. 4,592,940 to Blyth, et. al. (Monsanto Company), incorporated by reference. Such condensate products include products having repeating units of the formulas:

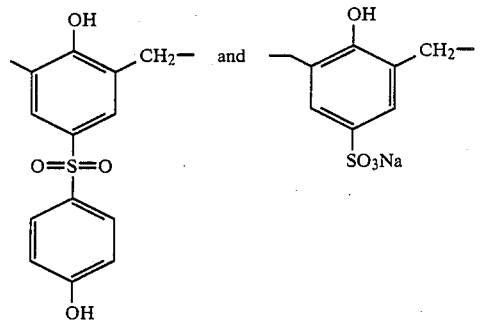

(A) (B)

where the product ratio of (A) to (B) is 60 to 40 and the product having repeating units of the formulas

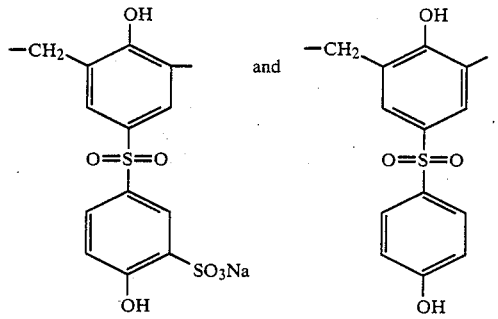

(C) (D)

where the ratio of units (C) to (D) is at least 8:1 and preferable as high as possible with products in which all of units are units (C) being preferred.

The molecular weight and the monosulfonate content of the water-soluble condensation product preferably is as high as possible, for example, a molecular weight ranging from 400 to 800 with a monosulfonate content of 100% or as near 100% as possible.

The water solubility of the condensation product is influenced by the type of terminal groups present in its structure, for example, hydrophilic groups such as —$CH_2OH$ and —$CH_2SO_3H$ render the product more water-soluble than other groups, such as methyl groups.

Other sulfonated colorless dye site blocker compounds within the scope contemplated by the present invention include the aliphatic sulfonic acids of the type disclosed in U.S. Pat. No. 4,699,812 to Munk, et. al. (Allied), incorporated by reference. Such aliphatic sulfonic acids have been reported to have certain advantages including their environmental safety, biodegradability and their ease of preparation without associated environmental hazards.

Such aliphatic sulfonic acids may be either an alkyl ($C_nH_{2n+1}$) or an alkenyl ($C_nH_{2n-1}$), i.e., monounsaturated paraffinic, sulfonic acid. Whether an alkyl or alkenyl sulfonic acid, those of this invention contain from about 8 to about 24 carbon atoms, and those containing from 8 to about 20 carbon atoms are particularly preferred in the practice of our invention. The aliphatic sulfonic acids may be either linear or branched sulfonic acids, and in fact it is quite desirable to have branching in the alkyl or alkenyl portion to increase lipophilicity. Especially desired is branching at the carbon bearing the sulfonic acid moiety, that is, secondary alkyl and alkenyl sulfonic acids are preferred species. Where the aliphatic portion is an alkenyl group the site of unsaturation is not important to the success of our invention and may occur anywhere along the carbon chain.

Examples of alkyl groups which may be used in the sulfonic acids of this invention include, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, and tetracosyl groups. The alkenyl groups which may be used are the monounsaturated analogs of those above, that is, octenyl, nonenyl, decenyl, undecenyl, etc.

Illustrative of the aliphatic sulfonic acids are 1-octane sulfonic acid, 1-nonane sulfonic acid, 1-decane sulfonic acid, 1-undecane sulfonic acid, 1-dodecane sulfonic acid, etc., as exemplary of the linear or unbranched alkyl sulfonic acids. To illustrate the branched alkyl sulfonic acids one can mention 2-octane sulfonic acid, 3-octane sulfonic acid, 4-octane sulfonic acid, 5,5-dimethyl-2-hexane sulfonic acid, 5,6,7-trimethyl-3-dodecane sulfonic acid, 4,6,9,10-tetramethyl-2-undecane sulfonic acid, 4,6,9,10-tetramethyl-3-undecane sulfonic acid, etc. Exemplary of the alkenyl sulfonic acids are such materials as 2-dodecene-1-sulfonic acid, 3-dodecene-1-sulfonic acid, 4-dodecene-1-sulfonic acid, 11-dodecene-1-sulfonic acid, 4-dodecene-2-sulfonic acid, 11-dodecene-3-sulfonic acid, 11-dodecene-5-sulfonic acid, 10-methyl-10-undecene-1-sulfonic acid, 10-methyl-10-undecene-2-sulfonic acid, 8,9-dimethyl-9-decene-1-sulfonic acid, 5,5-dimethyl-7-decene-1-sulfonic acid, etc.

One may also may use cycloaliphatic sulfonic acids in the practice of this invention, especially cyclopentane and cyclohexane sulfonic acids where the ring is substituted with one or more alkyl groups so as to give a total carbon content between 8 and 24. Additionally, one can have any chemically unreactive substituent on the aliphatic or cycloaliphatic portion, especially those with the potential of lowering surface energy. The halogens, and particularly fluorine, are desirable substituents.

Still further, sulfonated phenol-formaldehyde which may preferably be employed in the compositions of the present invention, especially where yellowing of the carpeting product may be encountered, are of the type disclosed in European Patent No. 235,980 to Liss (E. I. DuPont De Nemours and Company). These compounds are modified sulfonated phenol formaldehyde condensation products in which: (a) between about 10 and 25 percent of the polymer units contain $SO_3^-$ radicals and about 90 to 75 percent of the polymer units contain sulfone radicals, and (b) a portion of the free hydroxyl groups thereof has been acylated or etherified. Acylation or etherification of the free hydroxyl group in general materially reduces the tendency of carpeting which has been cleansed with the cleaning composition to yellow on being exposed to nitrogen oxides or to ultraviolet light. Preferably the product may be modified further by separating it from lower molecular weight materials which may contribute to yellowing in the final product and which are soluble in water at a pH of between about 4 and 8 and recovering and using those portions of the modified condensation product which are insoluble in water under those conditions.

The polymeric sulfonated phenol-formaldehyde condensation products which can be used as starting materials for preparing these preferred, modified materials are of the type described in the prior art as being useful as dye resist agents or dye fixing agents. In other words, dye-reserving or agents which improve wetfastness of dyeings on polyamide fibers. These include the compounds disclosed by Blyth, et. al. and Ucci, et. al. in the patents referred to hereinabove. Examples of commercially available condensation products suitable for the invention are the Mesitol NBS product of Mobay Chemical Corporation (a condensation product prepared from bis-(4,hydroxyphenyl)-sulfone, formaldehyde, and phenol-sulfonic acid, see U.S. Pat. No. 3,790,344), as well as Erional NW (formed by condensing a mixture of naphthalene monosulfonic acid, bis (hydroxyphenyl) sulfone and formaldehyde, see U.S. Pat. No. 3,716,393).

Organic liquids which can be used include $C_1$ to $C_4$ aliphatic alcohols, high boiling hydrocarbon solvents and high boiling chlorinated hydrocarbon solvents. The hydrocarbon solvents are generally the petroleum distillates with a boiling point between about 100° C. and about 300° C. Low boiling organic liquids are generally unsuitable from a standpoint of vapors and flammability and higher boiling organic liquids do not evaporate from the carpet fibers at a rapid enough rate. Representative of commercially available hydrocarbon solvents are Stoddard solvent and odorless hydrocarbon solvent. These solvents usually consist of a petroleum distillate boiling at about 105° to 200° C. Properties of these solvents are comparable to those of British Standard White Spirits and domestic Mineral Spirits. Chemically these solvents consist of a number of hydrocarbons, principally aliphatic, in the decane region. Representative of the high boiling chlorinated hydrocarbon solvents are perchloroethylene, methylchloroform and 1,1,2-trichloro-1,2,2-trifluoroethane. The most preferred organic liquid is a high boiling hydrocarbon solvent.

Surfactants of a number of classes are satisfactory for use in the compositions of this invention. The selection of a surfactant is not critical but the surfactant should serve to lower the surface tension of the water in the composition to 40 dynes per centimeter or lower. Preferred anionic surfactants are long chain alcohol sulfate esters such as those derived from $C_{10}$–$C_{18}$ alcohols sulfated with chlorosulfonic acid and neutralized with an alkali. Also preferred are alkylene oxide additives of $C_6$–$C_{10}$ mono and diesters of ortho-phosphoric acid. Representative nonionic surfactants that can be used have the formula $$R(\overset{\overset{C_nH_{2n+1}}{|}}{O}CH-CH_2)_mR'$$

where n is 0 or 1, m is 3 to 20, R' is OH or $OCH_3$, R is $C_{12}$ to $C_{22}$ alkyl or phenyl or naphthyl optionally substituted by $C_1$ to $C_{10}$ alkyl groups.

Anionic materials, such as the sulfonated, colorless dye site blockers of this invention, tend to form water insoluble precipitates with typical cationic surfactants. Careful selection and formulation of components where a cationic surfactant is employed to obtain desired properties will be required. Representative cationic surfactants that may be used are quaternary compounds of the structure $[RNR_1R_2R_3]^+X^-$ where R is $C_{12}$ to $C_{22}$ and includes the commercially important mixtures of alkyls obtained from tallow, hydrogenated tallow and cocoa. $R_1$ and $R_2$ is $CH_3$, $CH(CH_3)CH_2OH$ or $CH_2CH_2OH$. $R_3$ is $CH_3$, $C_2H_5$ or $C_6H_5CH_2$, and X is $Cl^-$, $Br^-$, $I^-$ or $CH_3SO_3^-$.

The surfactant can be a mixture of a nonionic surfactant and either an anionic surfactant or a cationic surfactant. Mixtures of anionic and cationic surfactants are suitable only in carefully selected cases. A preferred composition contains from 1 to 4% nonionic surfactant and 1 to 4% cationic surfactant. A satisfactory mixture of commercial anionic surfactants comprises (1) 0.4% of the sodium salt of a mixture of $C_{10}$–$C_{18}$ alcohol sulfates, predominantly $C_{12}$, (2) 0.4% of the diethylcyclohexylamine salt of the same sulfate mix, and (3) 0.2% of the product formed by reacting a mixture of n-octyl mono and diesters of ortho-phosphoric acid with sufficient ethylene oxide to form a neutral product, ordinarily about 2 to 4 mols of ethylene oxide per mol of phosphoric ester. The surfactant is normally used in amounts ranging from 0.5 to 5.0% by weight but useful amounts are not limited to this range.

In the case of dry-type cleaning compositions, in general, a sufficient amount of a particulate material generally, at least about 30 percent, must be included in the composition so that the composition is in the form a solid or flowable type material. A wide variety of solid materials have been proposed for such compositions including naturally-occurring materials such as wood particles, e.g., "sawdust" and wood flour, particles made from grains and other vegetable matter and inorganic particles, such as silicates, borates, etc. The solid material may also be a synthetic resin material such as urea formaldehyde, polyurethane, polystyrene and phenol-formaldehyde resin particles of the type disclosed in French Patent No. 2,015,972. A preferred solid material for use in such compositions is the type which has been disclosed more recently in U.S. Pat. No. 4,013,594 to Froehlich, et. al. (incorporated by reference) wherein particulate, polymeric ureaformaldehyde particles were proposed for use in providing dry-type cleaning compositions. These particulate urea formaldehyde materials were distinguished in the Froehlich patent from those of the earlier French patent based upon a fairly broad range of parameters, and in particular significance was attributed to the fact that as compared to the particles of the French patent, those of the Froehlich patent in general had a somewhat higher bulk density of at least about 0.2 grams per cc. Such higher bulk density characteristics resulted in generally increased cleaning effectiveness as compared to the prior art particles.

According to a preferred embodiment of the present invention, the cleaning composition is a dry-type particulate polymeric cleaning composition having high soil removal capacity as well as improved performance characteristics on fifth generation nylon fibers in that the tendency to destroy or mask the stain resistance characteristics of such fibers is minimized or eliminated entirely.

A wide variety of synthetic organic polymers may be used to prepare the polymeric particles employed in the composition. Included among the group of satisfactory polymers are polystyrene, ureaformaldehyde resins, polyvinyl chloride, polyacrylics, polyethylene, polypropylene, and acrylonitrile-butadiene-styrene terpolymer. Ureaformaldehyde is preferred.

In general the polymeric particles may have a compact, uniform configuration which results in a bulk density of at least about 0.2 g/cc. The bulk density may be determined by conventional techniques, involving weighing a quantity of particles which fill a calibrated container without packing.

The polymeric particles of the invention may be quite porous and in fact, high porosity may be preferred. Porosity of the polymeric particles measured by an oil value as determined by Method D281 of the American Society for Testing may be an oil value of at least 90. Lower oil values may not carry sufficient cleaning fluid. Oil values over 130 are preferred.

Average particle size of the particles should be from about 37 microns to about 105 microns as determined by sieve analysis. In general, particle size distribution should be such that not more than about 10 percent of the particles are larger than about 105 microns and in general no more than about 5 percent of the particles are smaller than about 10 microns. Larger particles do not penetrate carpet material adequately, and use of such particles would results in only superficial cleaning at best. Larger particles also have insufficient surface area to absorb a large amount of soil per unit of weight. If the particles are smaller than about 10 microns in diameter, they may adhere to the individual carpet fibers and have a delustering or dulling effect on the color of the carpet. While particles between about 10 and 37 microns may be tolerated, they may not contribute to cleaning efficiency to any substantial extent so that the average particle size should be in excess of 37 microns.

Particles of satisfactory bulk density, porosity and size may be obtained by a wide variety of polymerization techniques, although ordinarily the mere grinding of a foamed material to a preferred size may not produce a satisfactory product because such comminuted materials may not have appropriate bulk density and oil absorption characteristics to function satisfactorily.

Certain very tough plastics, however, such as the terpolymer formed from acrylonitrile, butadiene, and styrene, may be ground to particles having the desired characteristics because they fracture in a manner which produces particles having many jagged edges and high surface area. Existing techniques of polymerization and insolubilization enable the synthesis of porous particles which are sufficiently porous to take up more than their own weight of oil.

According to the preferred preparation, urea and formaldehyde may be polymerized in an acidic aqueous mixture containing a little surfactant to give particles exhibiting a high degree of porosity. Such technique is described in U.S. Pat. No. 2,766,283 to Warden (incorporated by reference) except that a urea/formaldehyde ratio of about 0.91/1.0 is used and the pH of the reaction is maintained at about 1.8.

It is to be understood, however, that the invention is not limited to polymeric particles prepared by any particular technique. Thus, for instance, suspension or precipitation techniques may also be employed with adjustment of conditions to obtain particles of the desired character.

The preferred cleaning composition of the present invention may include in addition to a particulate polymeric material from about 5 to about 400 parts, preferably from about 10 to about 200 parts by weight of an inorganic salt adjuvant. Such compositions are disclosed, for instance, in U.S. Pat. No. 4,434,067 to Malone, et al. (Milliken Research Corporation).

The parts by weight of inorganic salt which may be employed may include in addition to the weight of the salt per se some associated water of hydration. Such water of hydration is defined herein to include all water that cannot be driven off by heating a 1 to 1.5 gram sample to 100° C. for 2 hours. The inorganic salt may appropriately be referred to as an adjuvant because it may aid or modify the action of the principal ingredients of the cleaning composition, that is the particulate polymeric material and fluid component. (See Webster's New International Dictionary, 2d Edition.) Such assistance or aid may be accomplished in the form of increased cleaning efficiency, as improved soil antiredeposition properties in the treated carpet as well as improved oil and water resistance properties of the treated substrate. A wide range of inorganic salts may be employed so long as the salt is characterized as having an average particle size of from about 45 to about 600 microns in diameter. Particles of less than about 45 microns may not be used because retrieval problems may occur. Particles of more than about 600 microns may not be used because cleaning efficiency may be adversely affected. Inorganic salts which may advantageously be used include sulfates, chlorides, carbonates, bicarbonates, borates, citrates, phosphates, nitrates, metasilicates and mixtures thereof. The most preferred inorganic salts are the borate salts.

The minimum proportion of particulate material, e.g., polymeric particles and inorganic salt adjuvant, in the composition is about 105 parts, preferably about 120 parts, per 400 parts by weight of the total composition, as it is difficult to preserve the necessary "dry" character with lower proportions of solid. The fluid portion of the composition may thus form from about 10 percent to about 70 percent of the composition and is preferably from about 20 to about 50 percent by weight based upon the total composition weight. Where the cleaning fluid is a mixture of water and solvent there is no limit on the proportions of each which can be used.

Cleaning compositions of the invention have been found to be very effective for cleaning a wide range of fabric substrates, especially carpet constructions. Cleaning efficiency may be maintained at a very high level even when fairly large amounts of inorganic salt adjuvant, e.g., up to about 400 parts by weight per 100 parts by weight of particulate polymeric material are provided in the composition.

In preparing the cleaning compositions of this invention, best results may be obtained by combining the porous particles with enough of the desired cleaning fluid to almost saturate the particles. Thus it will be seen that a particle with low porosity cannot carry sufficient cleaning fluid to produce a composition having the maximum cleaning power. The optimum amount of cleaning fluid varies depending upon the properties of the particular particle.

The invention may be further understood by reference to the following examples which are not to be construed as limiting the scope of the subject matter of the invention which is further defined in the claims appended hereto. Unless otherwise indicated all parts and percentages are by weight.

TEST PROCEDURE A

Resistance to Red Dye No. 40 Staining

To test the stain resistance of carpet the following procedure is used. A solution of unsweetened cherry flavored Kool Aid, a product of General Foods (3.9 parts Kool Aid to 1900 parts water) is prepared daily and maintained at a temperature of 70°-80° F. Cherry-flavored Kool Aid contains Red Dye No. 40, a food-grade acid dye, as the predominant coloring component. Thirty milliliters of this solution are then poured from a height of 12 inches into a three inch diameter plastic pipe positioned vertically on a section of carpet. When the liquid is absorbed into the carpet the pipe section is removed and the stain is allowed to dry at room temperature for various designated times, e.g., fifteen minutes, four hours and twenty-four hours. When the time for drying has expired, the stain is saturated with water and blotted with clean paper towels. The process of saturation with water followed by blotting with paper towels is repeated until no further removal of color is observed. The carpet is then allowed to dry and the residual stain is compared to a series of standards. These standards are imbedded in a clear plastic sheet and range from 0 with no visible color in half units to 8.0 that is very dark red. In general, ratings of 1.5 or below correspond to very light tint of pink and are typical of commercially available stain resistant polyamide carpet performance prior to cleaning. Ratings from 2.0 to 4.0 correspond to significant observable stains that would be unacceptable in most commercial applications. Ratings of 4.5 to 8.0 represent substantial to complete loss in stain resistance with a red stain present. Each numerical step represents an approximate doubling of the intensity of the stain.

TEST PROCEDURE B

Cleaning Procedure for Carpet

New carpet with a light gray or beige color is cut into 5×5 inch test squares. These squares are mounted into a matching, cut out square in a 3×3 foot carpet taped to the floor. Each carpet cleaning product is applied following the manufacturer's recommended application conditions. The product is worked into the carpet using ten hand strokes in one direction, rotating the sample 90 degrees, and using ten more strokes in the same direction. The sample is allowed to dry at room temperature. Then the cleaning procedure described above is repeated.

TEST PROCEDURE C

Test strips of nylon pile carpet which are undyed and untreated for stain resistance are cut 1" by 4". The carpet sample is saturated with test cleaning solution, squeezed dry, then saturated again and squeezed dry.

The samples are allowed to stand five minutes, then rinsed under running tap water and squeezed dry. The samples were stained by saturating the carpet with cherry Kool Aid solution and allowed to dry 12 hours. The samples were then rinsed under running tap water and evaluated as in Test Procedure A.

"DRY TYPE" CLEANING COMPOSITIONS

Example 1

To a stainless steel Hobart mixer is added 517 parts ureaformaldehyde polymer containing 278 parts water and having a particle size distribution typically of from ten to 120 microns. The particles are prepared as described in U.S. Pat. No. 4,013,544 to Froehlich. Extender solids, such as sodium borate (910 parts), are added. (See U.S. Pat. No. 4,434,067 to Malone for other extenders.) The mixture is stirred at low speed and a solution of 12.3 parts nonionic surfactant (Triton X-45), 28.4 parts isopropyl alcohol, 5.78 parts fragrance (Lemon Reodorant), 0.1 parts optical brightener (Calcofluor White RW), and 26.6 parts water is added dropwise through an addition funnel mounted so that the liquid falls into the powder mixture. When this addition is complete a mixture of 100 parts colorless dye site blocker, a condensed, aromatic sulfonate, Dyeweld SUPR, a product of Sybron Chemicals Inc., in 114 parts water is added dropwise as before. The parts of colorless dye site blocker may be varied but the total mixture in water added is 214 parts. The product obtained is a flowable, solid mixture that dries to a powder that can be retrieved from carpet by vacuum.

Example 2

To a stainless steel Hobart mixer is added 500 parts of a commercially available, crushed ureaformaldehyde foam aqueous-based cleaning composition (Sapur, a product of Thompson). The mixture is stirred at low speed and 25 parts of colorless dye site blocker (a condensed aromatic sulfonate) Dyeweld SUPR, a product of Sybron Chemicals Inc. is sprayed onto the mixture. The product obtained is a flowable solid mixture that dries to a solid that can be retrieved from carpet by vacuum.

Example 3

To a stainless steel Hobart mixer is added 500 parts of a commercially available, solvent-containing, wood powder-based cleaning composition (Host, a product of Racine Industries). The mixture is stirred at low speed and 25 parts of colorless dye site blocker Dyeweld SUPR is sprayed onto the mixture. The brown, flowable, solid mixture dries to a solid that can be retrieved from carpet by vacuum.

Example 4

The procedure used in Example 1 is used except the colorless dye site blocker is Grifftex CB-130, a condensed aromatic sulfonate (a product of Grifftex Chemicals).

Example 5

The procedure used in Example 1 is used except the colorless dye site blocker was dodecylsulfonic acid, an aliphatic sulfonic acid (purchased from Aldrich Chemical Company).

Example 6

The procedure used in Example 1 is used except the colorless dye site blocker was an alkylaromatic sulfonic acid, dodecylbenzenesulfonic acid sodium salt (purchased from Aldrich Chemical Company).

Example 7

The procedure used in Example 1 was used except the colorless dye site blocker was an aliphatic sulfonated polyester, Nekal WS-25 (a product of GAF Corporation).

Example 8

The procedure used in Example 1 was used except the colorless dye site blocker was a condensed, naphthalene sulfonic acid, Blancol (a product of GAF Corporation).

Example 9

The procedure used in Example 1 is used except the colorless dye site blocker is a lignin sulfonate, Daxad 11G (a product of W. R. Grace).

In TABLE 1 below a sample of fifth generation nylon carpet is first cleaned as described in Test Procedure B above with the various carpet cleaning formulations identified in the Table. Cleaning is performed, both "with" a colorless dye site blocker as identified in the above examples and "without" the addition of the dye site blockers using the standard, commercial formulation. Then the carpet sample (Nylon 6) is stained as described in Test Procedure A and rated. The right-hand column provides results using this procedure for Nylon 6/6 samples. A control sample of fifth generation nylon carpet was also stained and then rated as described above. Both showed excellent performance before cleaning with standard cleaning formulations.

TABLE 1

Residual Staining Using Dry Type Cleaners of Fifth Generation Nylon 6 and Nylon 66 Carpets (24 Hrs. Stain)

| Cleaning Product | | Colorless Dye Site Blocker Present | Nylon 6 (Steam Set) | Nylon 6/6 |
|---|---|---|---|---|
| Ureaformaldehyde based cleaner | Ex. 1 | With Dyeweld SUPR | 0.5 | 0.5 |
| | | Without | 4.0 | |
| Crushed Polymer foam based cleaner | Ex. 2 | With Dyeweld SUPR | 0.5 | |
| | | Without | 1.0 | |
| Wood powder based cleaner | Ex. 3 | With Dyeweld SUPR | 0.5 | |
| | | Without | 1.0 | 0.5 |
| Ureaformaldehyde based cleaner | Ex. 4 | With Grifftex CB-130 | 0.5 | |
| | | Without | 4.0 | |
| Ureaformaldehyde based cleaner | Ex. 5 | With Dodecane sulfonic acid | 2.5 | |
| | | Without | 4.0 | |

TABLE 1-continued

| Residual Staining Using Dry Type Cleaners of Fifth Generation Nylon 6 and Nylon 66 Carpets (24 Hrs. Stain) | | | | |
|---|---|---|---|---|
| Cleaning Product | | Colorless Dye Site Blocker Present | Nylon 6 (Steam Set) | Nylon 6/6 |
| Ureaformaldehyde based cleaner | Ex. 6 | With Dodecylbenzene sulfonic acid | 2.0 | |
| | | Without | 4.0 | |
| Ureaformaldehyde based cleaner | Ex. 7 | With Nekal WS-25 | 0.5 | |
| | | Without | 4.0 | |
| Ureaformaldehyde based cleaner | Ex. 8 | With Blancol | 0.5 | |
| | | Without | 4.0 | |
| Ureaformaldehyde based cleaner | Ex. 9 | With Daxad 11G | 0.5 | |
| | | Without | 4.0 | |
| Control* | | — | 0.5 | 0.5 |

*Testing 24 hr. stain by Test Procedure A of previously uncleaned carpet

LIQUID TYPE CLEANING COMPOSITIONS

Example 10

To ninety-five parts of a series of commercially-available, cleaning compositions 5 parts of various colorless, dye site blockers are added. The cleaning compositions are then used to clean various fifth generation nylon carpets identified in TABLE 2 below using Test Procedure B. The carpet is then stained and evaluated as in Test Procedure A and the results are reported in TABLE 2. Comparisons are provided to carpet samples cleaned using the commercial formulation without any dye site blocker and the results are reported. The liquid cleaning formulations tested include Cleanmore Carpet Cleaner which is an anionic carpet cleaner available from Sears, Marko Steam and Extractor, an anionic carpet cleaner available from Marko Chemical, Inc., Turbo Shampoo an anionic carpet cleaner from Electrolux Corporation; Woolite spray, an amphoteric cleaner from Boyle-Midway, Inc., Promaster, an anionic cleaner from Bishop Clean Care, Inc. and Resolve, a nonionic cleaner from d-Con Company, Inc. Results for a control (carpet not previously cleaned) are also reported as the last entry in TABLE 2.

TABLE 2

| Residual Staining Using Liquid Cleaners (24 Hrs. Stain) | | | | |
|---|---|---|---|---|
| | Carpet Style Nylon 6 | | | |
| Cleaning Product | Steam Set | Heat Set | Nylon 6/6 | Colorless Dye Site Blocker |
| Sears Formula #1 | 1.0 | 0.5 | | Dyeweld SUPR |
| Sears Formula #1 | 1.5 | 0.5 | | Grifftex CB-130 |
| Sears Formula #1 | 3.0 | | 0.5 | None |
| Promaster LPP Steamex | 4.0 | 2.0 | | Dyeweld SUPR |
| Promaster LPP Steamex | 3.0 | 1.0 | | Grifftex CB-130 |
| Promaster LPP Steamex | 4.0 | | | None |

TABLE 2-continued

| Residual Staining Using Liquid Cleaners (24 Hrs. Stain) | | | | |
|---|---|---|---|---|
| | Carpet Style Nylon 6 | | | |
| Cleaning Product | Steam Set | Heat Set | Nylon 6/6 | Colorless Dye Site Blocker |
| Marko Steam and | 3.0 | 1.5 | | Dyeweld SUPR |
| Extractor Steamex | 2.0 | 2.0 | 0.5 | Grifftex CB-130 |
| Extractor Steamex | 5.5 | | | None |
| Resolve | 0.5 | 0.5 | | Dyeweld SUPR |
| Resolve | 0.5 | 0.5 | | Grifftex CB-130 |
| Resolve | 2.5 | | 2.0 | None |
| Woolite | 3.0 | | 1.0 | None |
| Electrolux | 0.5 | | 0.5 | Dyeweld SUPR |
| Electrolux | 0.5 | 0.5 | 0.5 | Grifftex CB-130 |
| Electrlux | 3.0 | | 0.5 | None |
| None | 0.5 | 0.5 | 0.5 | |

Example 11

Using Test Procedure C various aqueous solutions of surfactant/colorless dye site blocker compositions are screened to test if the detergent effects of the surfactant at various concentrations in aqueous solution negate the effect of the colorless dye site blocker in providing retention of stain resisting activity on fifth generation nylon carpets. The results are summarized in TABLE 3 below.

TABLE 3

| | SURFACTANT | | | | | | |
|---|---|---|---|---|---|---|---|
| | Triton X45 | | Sodium Lauryl Sulfate | | Dodecyl Benzene Sulfonate | | |
| Colorless Dye Site Blocker (5%) | 1% | 10% | 1% | 10% | 1% | 10% | None |
| 1. Blancol | 2.0 | 2.0 | 2.0 | 3.0 | 0.5 | 1.5 | 1.5 |
| 2. Nekal WS-25 | 2.5 | 2.0 | 2.5 | 1.0 | 0.5 | 1.0 | 1.0 |
| 3. Daxad 11G | 2.5 | 2.0 | 2.5 | 1.5 | 1.0 | 0.5 | 2.5 |
| 4. Grifftex CB-130 | 2.0 | 2.0 | 1.5 | 1.5 | 0.5 | 1.0 | 0.5 |
| 5. None | | | | | | | 5.0 |
| 6. 5% Sulfuric Acid | | | | | | | 5.0 |
| 7. 5% Hydrochloric Acid | | | | | | | 5.0 |

Example 12

This example illustrates the effect of pH on the activity of colorless dye site blocker. Five parts additive are mixed with 95 parts water. The pH is adjusted with either 5% sodium hydroxide or 5% sulfuric acid. Test strips of polyamide carpet are treated as in Test Procedure C except that the initially treated carpet is allowed to stand 30 minutes before rinsing. The carpet is thus stained using Test Procedure A and evaluated and the results are summarized below in TABLE 4.

TABLE 4

Effect of pH on Deposition of Colorless Dye Site Blocker

| pH | Residual Stain |
|---|---|
| 1.5 | 0.5 |
| 2.4 | Nil |
| 3.8 | 0.5 |
| 5.5 | 0.5 |
| 6.3 | 0.5 |
| 7.6 | 0.5 |
| 8.6 | 0.5 |
| 10.5 | 1.0 |
| Control (No additive) | 5.0 |

Commercial cleaning products range in pH from acid to alkaline. The colorless dye site blockers used are sulfonated materials and may be effected by the pH of their application. TABLE 4 shows that Dyeweld SUPR is effective from pH 1.5 to 10.5.

Example 13

To a stainless steel Hobart mixer the ingredients in Example 1 are added except sodium borate was not added and 10 parts of a condensed aromatic sulfonate, Dyeweld SUPR, in 97 parts of water is added to give a flowable solid mixture that dries a powder than can be retrieved from carpet by vacuum.

Example 14

Using the procedure in Example 1, 200 parts colorless dye site blocker, a condensed aromatic sulfonate, Dyeweld SUPR diluted with 14 parts water is added. A flowable solid mixture that dries to a powder that can be retrieved from carpet by vacuum was obtained.

EXAMPLE 15

Using the procedure in Example 1, 20 parts of a colorless dye site blocker, a condensed aromatic sulfonate, Dyeweld SUPR, in 194 of water is added. A flowable solid mixture that dries to a powder that can be retrieved from carpet by vacuum was obtained.

Example 16

The procedure in Example 14 was used except blocker is a condensed aromatic sulfonate, Grifftex CB-130. A flowable solid mixture that dries to a powder that can be retrieved from carpet by vacuum is obtained.

Example 17

The procedure in Example 15 is used except that the colorless dye site blocker was a condensed aromatic sulfonate, Grifftex CB-130. A flowable solid mixture that can be retrieved from carpet by vacuum is obtained.

Example 18

The procedure in Example 1 was used except that 100 parts of the colorless dye site blocker, a condensed aromatic sulfonate, Dyeweld SUPR is mixed with 100 parts Teflon CSF (a fluorocarbon product of DuPont) and 14 parts water is then added as described. The product obtained is a flowable solid mixture that dries to a powder that can be retrieved from carpet by vacuum.

TABLE 5

Summary of staining results after cleaning with products prepared as described in Examples 13–17 show effectiveness of various concentrations of dye site blocker compound.

| | Additive | | Residual Stain | |
|---|---|---|---|---|
| Example | Level (Parts) | Sodium Borate | Nylon 6 | Nylon 6/6 |
| 13 | 10 | 0 | 2.0 | |
| Control | 0 | | 5.5 | |
| 14 | 200 | 910 | 0.5 | |
| 1 | 100 | 910 | 1.0 | 0.5 |
| 15 | 20 | 910 | 3.0 | |
| 16 | 200 | 910 | 0.5 | |
| 4 | 100 | 910 | 0.5 | |
| 17 | 20 | 910 | 3.0 | |
| 18 | 100 + 100 | 910 | 0.5 | 0.5 |
| Control | 0 | 910 | 5.0 | 1.0 |

What is claimed is:

1. A cleaning composition for carpeting which comprises: (1.) a cleaning fluid selected from water containing sufficient surfactant to lower the surface tension to below 40 dynes per centimeter, an organic liquid selected from $C_1$ to $C_4$ aliphatic alcohols, high boiling hydrocarbon solvents and high boiling chlorinated hydrocarbon solvents, or mixtures of water, surfactant and said organic liquid; and (2.) a sulfonated, colorless dye site blocker provided in a sufficient amount to prevent or minimize deterioration of stain resistance properties in fifth generation nylon carpets; and wherein furthermore said dye site blocker is selected from aliphatic sulfonated polyesters; lignin sulfonates; sulfonated phenol-formaldehyde condensation products; condensation products prepared from mono-sulfonic acids having repeating units of the formula:

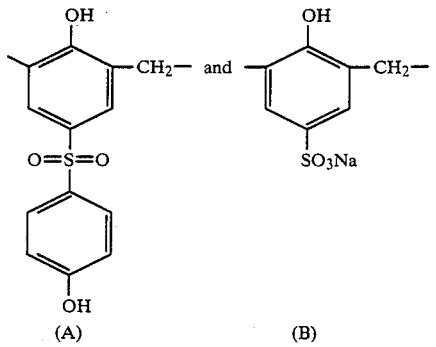

wherein the product ratio of (A) to (B) is 60 to 40 in the product having repeating units of the formulas:

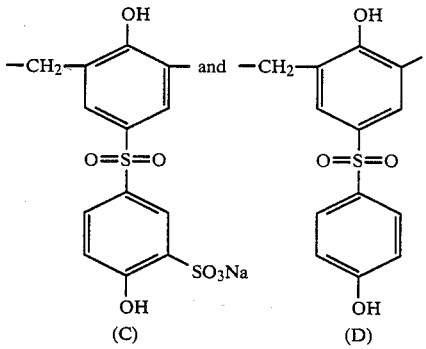

where the ratio of units (C) to (D) is at least 8 to 1 sulfonated phenolformaldehyde condensation products in which from about 10 to 25 percent of the polymer units contain $SO_3$ radicals and about 90 to 75 percent of the polymer units contain sulfone radicals and in which a portion of the free hydroxyl groups thereof have been acylated or etherified.

2. The cleaning composition of claim 1 wherein said surfactant is selected from anionic surfactants, cationic surfactants and nonionic surfactants.

3. The cleaning composition of claim 2 wherein said anionic surfactants are selected from long chain alcohol sulfate esters and alkylene oxide additives of $C_6$–$C_{10}$ mono- and di-esters of orthophosphoric acid.

4. The cleaning composition of claim 2 wherein said nonionic surfactants are selected from compounds of the formula:

$$R(\overset{\overset{C_nH_{2n+1}}{|}}{O}CH-CH_2)_mR'$$

wherein n is 0 or 1; m is 3 to 20; R′ is OH or $OCH_3$; R is $C_{12}$ to $C_{22}$ alkyl or phenyl or naphthol.

5. The cleaning composition of claim 2 wherein said cationic surfactant is selected from quaternary compounds of the structure $[RNR_1R_2R_3]^+X^-$ where R is $C_{12}$ to $C_{22}$; $R_1$ and $R_2$ are each independently selected from: $CH_3$, $CH(CH_3)CH_2OH$ or $CH_2CH_2OH$. $R_3$ is $CH_3$, $C_2H_5$ or $C_6H_5CH_2$ and X is $Cl^-$, $Br^-$, $I^-$ or $CH_3SO_3^-$.

6. The cleaning composition of claim 1 which is a dry-type cleaning composition further containing a particulate material in an amount of at least about 30 percent so that the composition is in the form of a solid or flowable type material.

7. The cleaning composition of claim 6 wherein said particulate material is selected from ureaformaldehyde, polyurethane, polystyrene, phenol-formaldehyde resin particles.

8. The cleaning composition of claim 7 wherein said particulate material is polymeric ureaformaldehyde particles having a bulk density of at least about 0.2 grams per cc.

9. The cleaning composition of claim 8 wherein said cleaning composition further contains from about 5 to about 400 parts by weight of an inorganic salt adjuvant per 100 parts by weight particulate polymeric material.

10. The cleaning composition of claim 9 wherein said inorganic salt adjuvant is sodium borate.

11. A powdered cleaning composition for carpeting which comprises: (1) a cleaning fluid selected from water containing sufficient surfactant to lower the surface tension to below 40 dynes per centimeter, an organic liquid selected from $C_1$ to $C_4$ aliphatic alcohols, high boiling hydrocarbon solvents and high boiling chlorinated hydrocarbon solvents; or mixtures of water, surfactant and said organic liquid; (2) a particulate material in an amount of at least about 30 percent by weight based upon the weight of said composition; and (3) a sulfonated, colorless dye site blocker provided in a sufficient amount to prevent or minimize deterioration of stain resistance properties in fifth generation nylon carpets and wherein furthermore said dye site blocker is selected from aliphatic sulfonated polyesters; lignin sulfonates; sulfonated phenol-formaldehyde condensation products; condensation products prepared from mono-sulfonic acids having repeating units of the formulas:

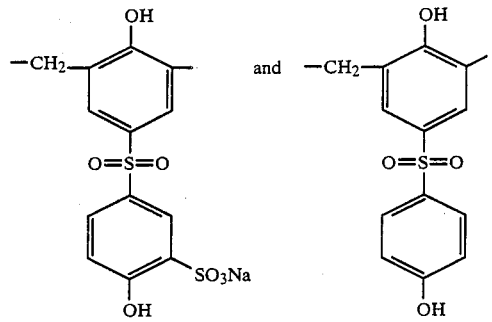

(C) (D)

wherein the product ration of (A) to (B) is 60 to 40 in the product having repeating units of the formulas:

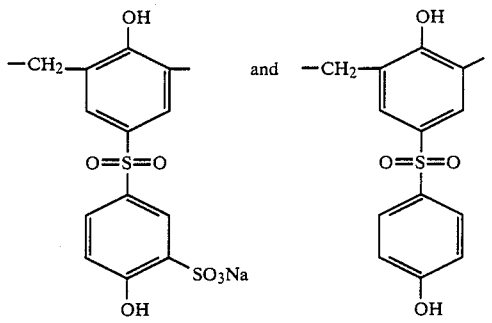

(C) (D)

where the ratio of units (C) to (D) is at least 8 to 1; sulfonated phenol-formaldehyde condensation products in which from about 10 to 25 percent of the polymer units contain $SO_3$ radicals and about 90 to 75 percent of the polymer units contain sulfone radicals and in which a portion of the free hydroxyl groups thereof have been acylated or etherified.

12. The powdered cleaning composition of claim 11 wherein said particulate material is selected from wood particles, particles made from grains and other vegetable matter, inorganic particles and synthetic resins.

13. The powdered cleaning composition of claim 12 wherein said synthetic resin are selected from ureaformaldehyde, polyurethane, polystyrene and phenol-formaldehyde.

14. The powdered cleaning composition of claim 13 wherein said ureaformaldehyde particles have a bulk density of at least about 0.2 grams per cc.

15. The composition of claim 11 wherein said surfactant is selected from anionic surfactants, cationic surfactants and nonionic surfactants.

* * * * *